US008251683B2

(12) United States Patent
Byun et al.

(10) Patent No.: US 8,251,683 B2
(45) Date of Patent: Aug. 28, 2012

(54) VARIABLE CAPACITY ROTARY COMPRESSOR

(75) Inventors: Sang-Myung Byun, Gyeongsangnam-Do (KR); Jeong-Min Han, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 653 days.

(21) Appl. No.: 12/448,525

(22) PCT Filed: Dec. 24, 2007

(86) PCT No.: PCT/KR2007/006798
§ 371 (c)(1),
(2), (4) Date: Jun. 24, 2009

(87) PCT Pub. No.: WO2008/078946
PCT Pub. Date: Jul. 3, 2008

(65) Prior Publication Data

US 2010/0092324 A1 Apr. 15, 2010

(30) Foreign Application Priority Data

Dec. 27, 2006 (KR) ..... 10-2006-0135595

(51) Int. Cl.
*F03C 2/00* (2006.01)
*F04C 2/00* (2006.01)

(52) U.S. Cl. ..... 418/11; 418/23; 418/60; 418/270; 417/213; 417/440

(58) Field of Classification Search ..... 418/11, 418/23, 60, 63, 270; 417/440, 441, 442, 417/213
See application file for complete search history.

(56) References Cited

U.S. PATENT DOCUMENTS 7,611,341 B2 * 11/2009 Byun et al. ..... 418/60
7,798,791 B2 * 9/2010 Byun et al. ..... 418/60

FOREIGN PATENT DOCUMENTS

KR 10-0595766 B1 6/2006
WO WO 2006/090977 A1 8/2006
WO WO 2006/090978 A1 8/2006

* cited by examiner

*Primary Examiner* — Theresa Trieu
(74) *Attorney, Agent, or Firm* — McKenna Long & Aldridge LLP

(57) ABSTRACT

A variable capacity rotary compressor includes a rolling piston eccentrically rotated in the compression space of the cylinder assembly, and a vane coming in contact with the rolling piston. A vane restricting device restricts the vane by applying a pressure onto a side face of the vane, where a sectional area A of a passage through which the restriction pressure is applied to the side face of the vane is formed so as not to be larger than a vane area B of the vane to which the restriction pressure is applied through a passage. The passage includes a first passage for connecting an inner space of the casing to a vane slot which is provided in the cylinder assembly and has the vane slidably inserted therein, and a second passage for connecting the vane slot to an inlet which is connected to the suction chamber of the cylinder assembly.

10 Claims, 5 Drawing Sheets

[Fig. 1]
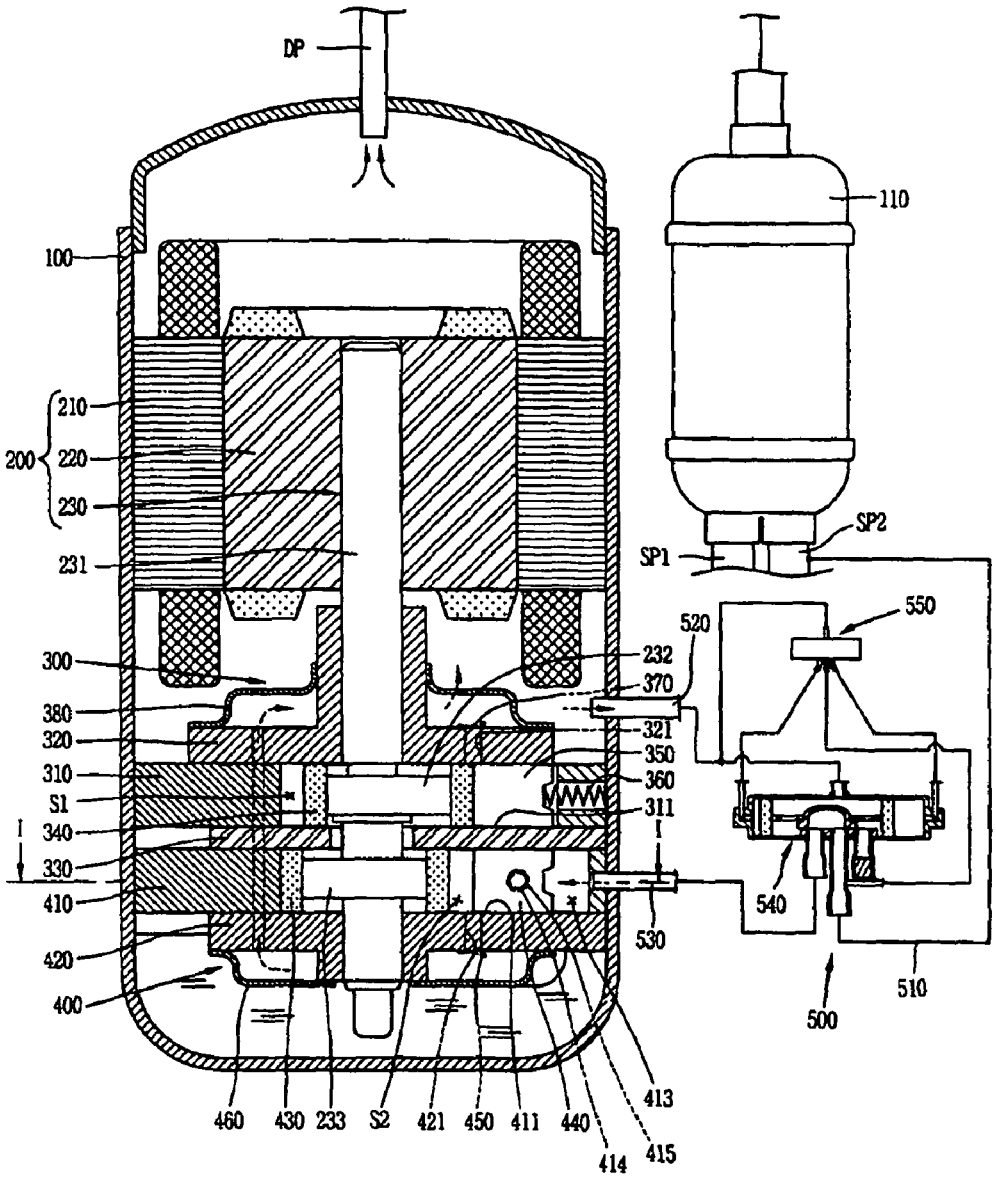

[Fig. 2]
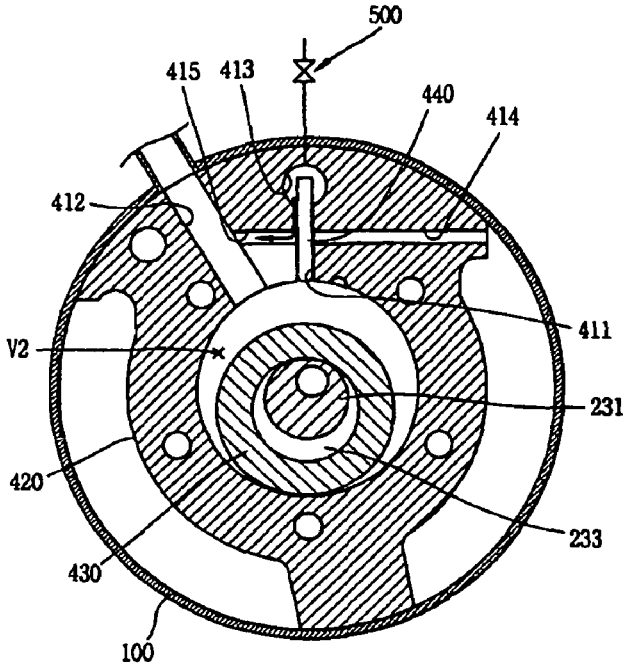
[Fig. 3]
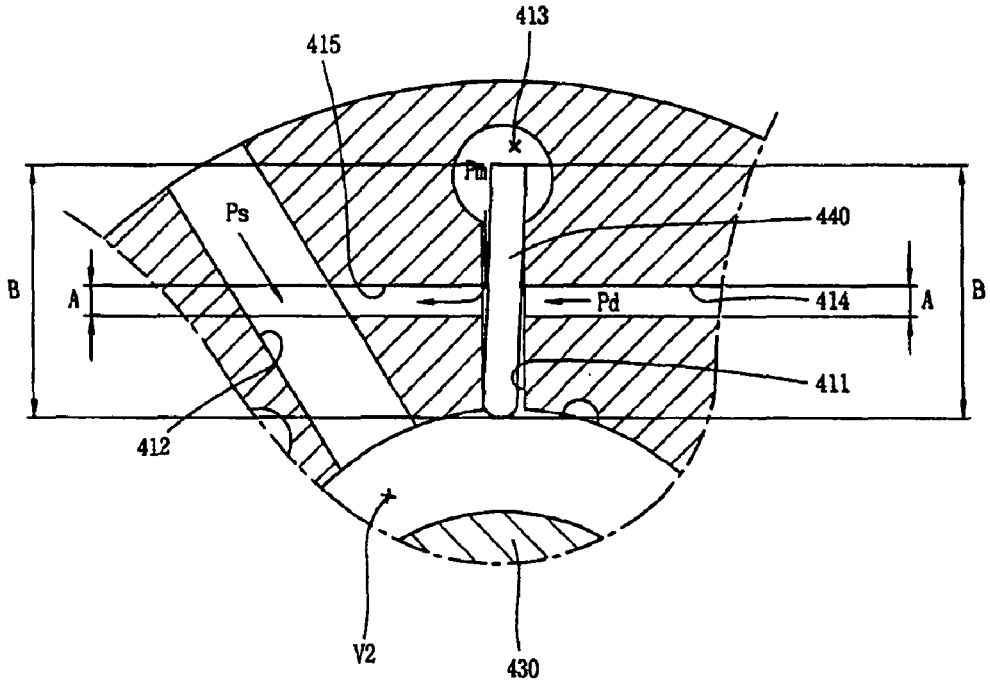

[Fig. 4]
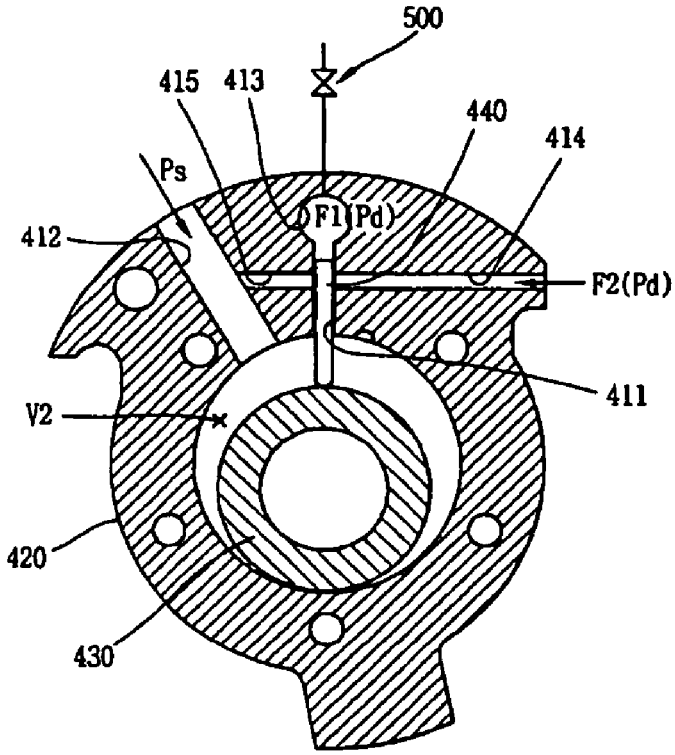
[Fig. 5]
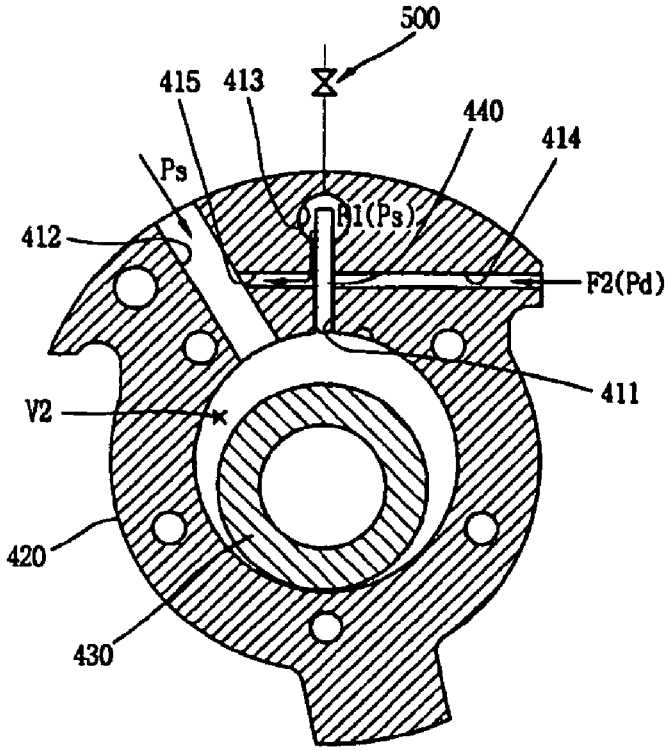

[Fig. 6]
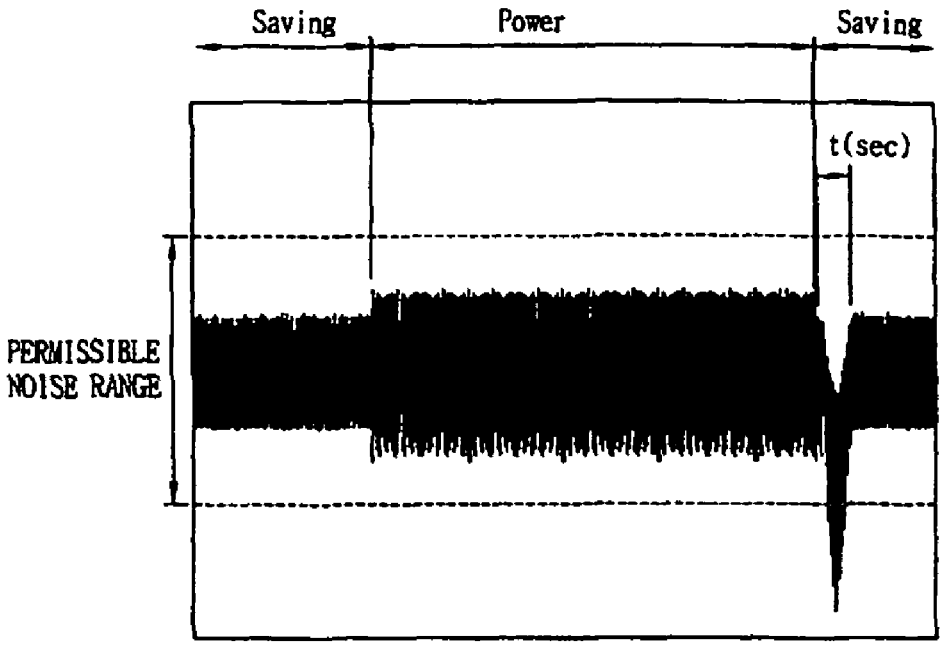
[Fig. 7]
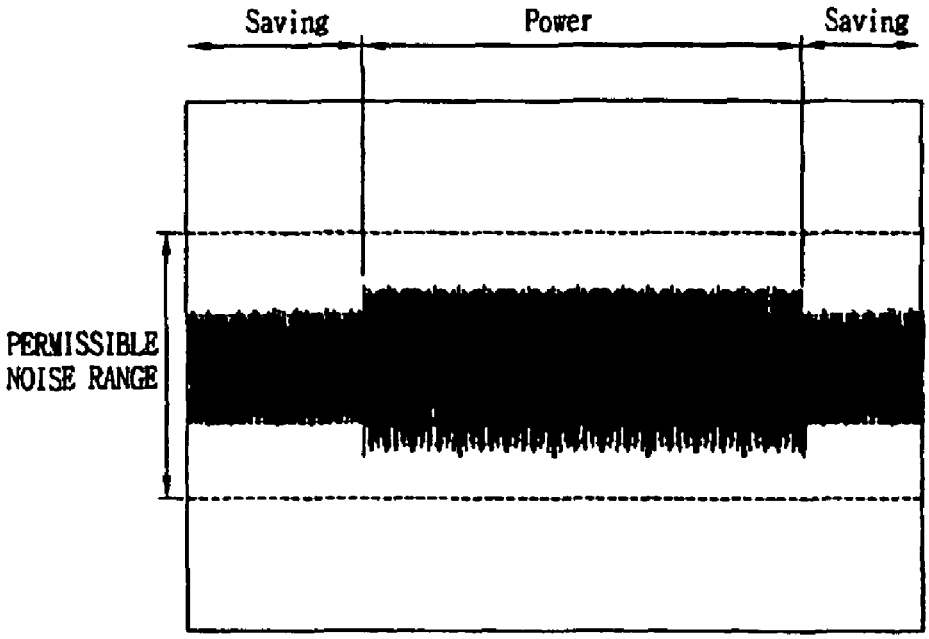

[Fig. 8]
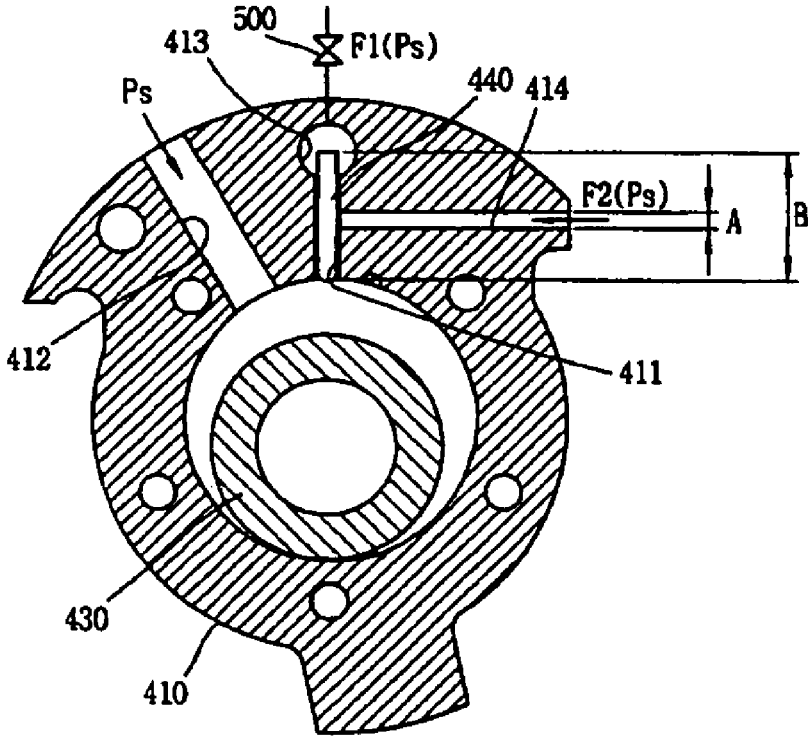

VARIABLE CAPACITY ROTARY COMPRESSOR

This application claims priority to PCT/KR2007/006798 filed on Dec. 24, 2007 and Korean Patent Application No. 10-2006-0135595 filed on Dec. 27, 2006, all of which are hereby incorporated by reference in their entirety.

TECHNICAL FIELD

The present invention relates to a rotary compressor having a variable capacity, and more particularly, to avoiding noise from being generated when converting a driving mode of the compressor.

BACKGROUND ART

In general, a rotary compressor adapts a method for compressing a refrigerant by using a rolling piston which eccentrically rotates inside a compression space of a cylinder and a vane which comes in contact with the rolling piston to divide the compression space of the cylinder into a suction chamber and a discharge chamber. Recently, a variable capacity rotary compressor, which is capable of varying a cooling capacity of a compressor according to the change in loads, has been introduced. In order to vary the cooling capacity of the compressor, a technique adapting an inverter motor, a technique for varying a capacity of a compressor by partially bypassing a compressed refrigerant out of a cylinder and the like, are being widely researched. However, in adapting the inverter motor to a compressor, a fabrication cost is increased due to high price of the inverter motor of the compressor. Furthermore, in bypassing a refrigerant, a piping system becomes complicated, which increases a flow resistance of the refrigerant, thereby degrading efficiency of the compressor.

Accordingly, a method has been proposed, by which the piping system can be simplified without using the inverter motor and also a capacity of a compressor can be varied. For example, upon a normal driving mode mode (power driving mode) of a compressor, a rolling piston and a vane are kept coming in contact with each other such that a suction chamber and a discharge chamber can be divided. On the other hand, upon a saving driving mode mode of the compressor, the rolling piston and the value are spaced apart from each other such that the suction chamber and the discharge chamber can be connected to each other. To this end, a linear reciprocation of the vane should be restricted or the restricted linear motion thereof should be released according to a driving mode of the compressor.

However, well-known vane restricting schemes in the related art can not completely restrict the vane for a certain time period when converting the compressor mode switching, thereby decreasing the performance of the compressor. In addition, the incomplete restriction of the vane severely generates noise when the vane is vibrated, which increases noise of the compressor. In particular, when the driving mode of the compressor is converted from the normal driving mode mode into the saving driving mode mode as shown in FIG. 2, noise is drastically generated for a certain time period.

DISCLOSURE OF INVENTION

Technical Problem

Therefore, it is an object of the present invention to provide a variable capacity rotary compressor capable of remarkably reducing noise of the compressor, caused when a vane collides against a rolling piston due to the vibration of the vane, by quickly restricting the vane upon converting a driving mode of the compressor.

Technical Solution

To achieve these objects, there is provided a variable capacity rotary compressor comprising: a casing; a cylinder assembly installed in the casing and having a compression space; a rolling piston eccentrically rotated in the compression space of the cylinder assembly; a vane coming in contact with the rolling piston to perform a linear reciprocation in a radial direction and dividing the compression space of the cylinder assembly into a suction chamber and a discharge chamber; and a vane restricting device for restricting a vane by applying pressure onto a side face of the vane, wherein a sectional area A of a passage for applying a restriction pressure onto the side face of the vane is formed so as not to be larger than a vane area B of the vane receiving the restriction pressure applied through the passage.

In more particularly, the present invention provides a variable capacity rotary compressor in which a ratio A/B between the sectional area A of the passage and the vane area B ranges from 1.5% to 16.4%.

Advantageous Effects

The variable capacity rotary compressor according to the present invention is allowed such that a sectional area of a vane restricting passage through which pressure is applied to one side or both sides of the vane is not larger than a vane area of the vane having the restriction pressure applied thereto, in more particularly, that a ratio between the sectional area and the vane area ranges from 1.5% to 16.4%. Accordingly, the compressor can smoothly perform a normal driving mode. Also, upon converting the normal driving mode into a saving driving mode, it is possible to previously prevent the vane from being vibrated, which can effectively decrease noise of the compressor.

BRIEF DESCRIPTION OF THE DRAWINGS

FIG. 1 is a horizontal sectional view showing a double type variable capacity rotary compressor in accordance with one embodiment of the present invention;

FIG. 2 is a sectional view taken along the line [I-I] of FIG. 1, which is a plane view showing a second compression part of the double type variable capacity rotary compressor of FIG. 1;

FIG. 3 is an enlarged view of a vane restricting device of FIG. 2;

FIGS. 4 and 5 are plan views showing the double type variable capacity rotary compressor of FIG. 1 in a normal driving mode and in a saving driving mode, respectively.

FIGS. 6 and 7 are graphs each showing noise measured by adapting a different ratio between a sectional area of a restricting passage and a vane area of a vane in the double type variable capacity rotary compressor of FIG. 1.

FIG. 8 is a plan view showing another embodiment of the double type variable capacity rotary compressor in accordance with the present invention.

BEST MODE FOR CARRYING OUT THE INVENTION

Typically, rotary compressors may be divided into single type rotary compressors and double type rotary compressors according to the number of cylinders. For example, for a single type rotary compressor, one compression chamber is formed using a rotational force transferred from a motor part. For a double type rotary compressor, a plurality of compression chambers having a phase difference of 180° therebetween are vertically formed using the rotational force transferred from the motor part. Hereinafter, an explanation will be given of a double type variable capacity rotary compressor in which a plurality of compression chambers are vertically formed, at least one of the plural compression chambers having a variable capacity. However, the present invention can also be applied to the single type variable capacity rotary compressor.

Hereinafter, a double type variable capacity rotary compressor will be described in detail according to one embodiment illustrated in the accompanying drawings.

As shown in FIG. 1, the double type variable capacity rotary compressor according to the present invention may include a casing 100 having a hermetic space, a motor part 200 installed at an upper side of the casing 100, a first compression part 300 and a second compression part 400 disposed at a lower side of the casing 100 to compress a refrigerant by a rotational force generated from the motor part 100, and a mode switching unit 500 for switching a driving mode such that the second compression part 400 can perform a normal driving mode (power driving mode) or a saving driving mode.

The hermetic space of the casing 100 may be maintained in a discharge pressure atmosphere by a refrigerant discharged from the first compression part 300 and the second compression part 400. A first gas suction pipe SP1 and a second gas suction pipe SP2 may be connected to a lower circumferential surface of the casing 100, respectively, so as to allow a refrigerant to be sucked into the first compression part 300 and the second compression part 400. A gas discharge pipe DP may be connected to an upper end of the casing 100 such that a refrigerant discharged from the first and second compression parts 300 and 400 to the hermetic space may be transferred toward a refrigerating system.

The motor part 200 may include a stator 210 fixed to the inside of the casing 100 and receiving power from outside, a rotor 220 disposed inside the stator 210 with a certain air gap therebetween and rotated by interaction with the stator 210, and a rotational shaft 230 coupled to the rotor 210 to transmit a rotational force to the first and second compression parts 300 and 400.

The rotational shaft 230 may include a shaft portion 231 coupled to the rotor 220, and a first eccentric portion 232 and a second eccentric portion 233 eccentrically disposed at both left and right sides below the shaft portion 231. The first and second eccentric portions 232 and 233 may be symmetrically disposed by a phase difference of approximately 180° therebetween. Accordingly, the first and second eccentric portions 232 and 233 may be respectively rotationally coupled to a first rolling piston 340 and a second rolling piston 430 to be explained later.

The first compression part 300 may include a first cylinder 310 having a ring shape and installed in the casing 100, an upper bearing plate 320 (hereinafter, referred to as 'upper bearing') and a middle bearing plate 330 (hereinafter, referred to as 'middle bearing') covering upper and lower sides of the first cylinder 310, thereby forming a first compression space V1, for supporting the rotational shaft 230 in a radial direction, a first rolling piston 340 rotatably coupled to an upper eccentric portion of the rotational shaft 230 and compressing a refrigerant by orbiting in the first compression space V1 of the first cylinder 310, and a first vane 350 coupled to the first cylinder 310 to be movable in a radial direction so as to be in contact with an outer circumferential surface of the first rolling piston 340 for dividing the first compression space V1 of the first cylinder 310 into a first suction chamber and a first discharge chamber. The first compression part 300 may further include a vane supporting spring 360 formed of a compression spring for elastically supporting a rear side of the first vane 350, a first discharge valve 370 openably coupled to an end of a first discharge opening 321 provided in a middle of the upper bearing 320 to control a discharge of a refrigerant discharged from the discharge chamber of the first compression space V1, and a first muffler 380 coupled to the upper bearing 320 and having an inner volume to receive the first discharge valve 370.

The first cylinder 310 may include a first vane slot 311 formed at one side of an inner circumferential surface thereof constituting the first compression space V1 for reciprocating the first vane 350 in a radial direction, a first inlet (not shown) formed at one side of the first vane slot 311 in a radial direction to introduce a refrigerant into the second compression space V2, and a first discharge guiding groove (not shown) inclinably installed at the other side of the first vane slot 311 in a shaft direction to discharge a refrigerant into the casing 100.

One of the upper bearing 320 and the middle bearing 330 may have a diameter shorter than that of the first cylinder 310 such that an outer end (or, rear end equally used hereafter) of the first vane 350 may even be supported by a discharge pressure of a refrigerant filled in the hermetic space of the casing 100.

As shown in FIGS. 1 and 2, the second compression part 400 may include a second cylinder 410 having a ring shape and installed at a lower side of the first cylinder 310 inside the casing 100, the middle bearing 330 and a lower bearing 420 covering upper and lower sides of the second cylinder 410, thereby forming a second compression space V2, for supporting the rotational shaft 230 in a radial direction and in a shaft direction, a second rolling piston 430 rotatably coupled to a lower eccentric portion of the rotational shaft 230 to compress a refrigerant by orbiting in the second compression space V2 of the second cylinder 410, and a second vane 440 coupled to the second cylinder 410 to be movable in a radial direction so as to contact to or separate from an outer circumferential surface of the second rolling piston 430 for dividing the second compression space V2 of the second cylinder 410 into a second suction chamber and a second discharge chamber or for connecting the second suction chamber and the second discharge chamber to each other. The second compression part 400 may further include a second discharge valve 450 openably coupled to an end of a second discharge opening 421 provided in the middle of the lower bearing 420 to control a refrigerant gas discharged from the second compression chamber, and a second muffler 460 coupled to the lower bearing 420 and having a certain inner volume to receive the second discharge valve 450.

The second cylinder 410 can be implemented such that the compression space V2 may have the same capacity as or a different capacity from the compression space V1 of the first cylinder 310. For example, in case where the two cylinders 310 and 410 have the same capacity, if the second cylinder 410 performs a saving driving mode, the compressor may be driven with a capacity corresponding to the capacity of another cylinder (e.g., the first cylinder 310), and thus, the function of the compressor may be varied up to 50%. On the other hand, in case where the two cylinders 310 and 410 have different capacities, the function of the compressor may be varied into a ratio corresponding to a capacity of a cylinder which performs a normal driving mode.

The second cylinder 410 may include a second vane slot 411 formed at one side of an inner circumferential surface thereof constituting the second compression space V2 for reciprocating the second vane 440 in a radial direction, a second inlet 412 (not shown) formed at one side of the second vane slot 411 to introduce a refrigerant into the second compression space V2, and a second discharge guiding groove (not shown) inclinably formed at the other side of the second vane slot 411 in a shaft direction to discharge a refrigerant into the casing 100.

As shown in FIGS. 2 and 3, a vane chamber 413 may be hermetically formed at a rear side of the second vane slot 411, and may be connected to a common side connection pipe 530 of a mode switching unit 500 that will be explained later. The vane chamber 413 may also be separated from the hermetic space of the casing 100 so as to maintain a rear side of the second vane 440 as a suction pressure atmosphere or a discharge pressure atmosphere. Also, a high pressure side vane restricting passage 414 (hereinafter, referred to as 'first passage') that connects the inside of the casing 100 to the second vane slot 411 in a perpendicular direction or an inclined direction to a motion direction of the second vane 440 and thereby restricts the second vane 440 by a discharge pressure inside the casing 100 may be formed at the second cylinder 410. A low pressure side vane restricting passage (hereinafter, referred to as 'second passage') which connects the second vane slot 411 to the second inlet 412 to generate a pressure difference with the first passage 414 so as to quickly restrict the second vane 440 may be formed at an opposite side to the first passage 414.

The vane chamber 413 connected to the common side connection pipe 530 to be explained later has a certain inner volume. Accordingly, even if the second vane 440 has been completely moved backward so as to be received inside the second vane slot 411, the rear surface of the second vane 440 may have a pressure surface for a pressure supplied through the common side connection pipe 530.

The first passage 414 may be positioned at the discharge guiding groove (not shown) of the second cylinder 410 based on the second vane 440, and may be penetratingly formed toward a center of the second vane slot 411 from an outer circumferential surface of the second cylinder 410. The first passage 414 may be formed to have a two-step narrowly formed toward the second vane slot 411 by using a two-step drill. An outlet of the first passage 414 may be formed at an approximately middle part of the second vane slot 411 in a longitudinal direction so that the second vane 440 can perform a stable linear reciprocation. Also, the first passage 414 may be formed at a position where the first passage 414 can be connected to the vane chamber 413 via a gap between the second vane 440 and the second vane slot 411 when the compressor is driven in the normal driving mode. Accordingly, a discharge pressure may be introduced into the vane chamber 413 to thusly increase pressure at a rear surface of the second vane 440. However, when the second vane 440 is restricted upon the saving driving mode of the compressor, if the first passage 414 is connected to the vane chamber 413, a pressure is increased in the vane chamber 413, and thereby the second vane 440 is retreated to thereby be possibly vibrated. Accordingly, it may be preferable to form the first passage 414 to be positioned within a reciprocating range of the second vane 440.

Preferably, a sectional area of the first passage 414 is equal or narrower to/than a pressure surface applied onto the rear surface of the second vane 440, namely, a sectional area of the second vane slot 411, thereby preventing the second vane 440 from being excessively restricted. For example, when dividing a sectional area A of the first passage 414 by a vane area B of the second vane 440, i.e., the vane area B of a side surface of the second vane 440 to which a restriction pressure is applied, a ratio (A/B) between the sectional area A of the first passage 414 and the vane area B of the vane 440 may be in a range from 1.5% to 16.4%. Accordingly, noise generated during a mode switching can be minimized.

Although not shown in the drawings, the high pressure side vane restricting passage 414 (i.e., the first passage) may be formed to be recessed by a certain depth in both side surfaces of the second cylinder 410, or may be recessed by a certain depth in the lower bearing 420 or the middle bearing 330 each of which is coupled to both side surfaces of the second cylinder 410 or formed through the lower bearing 420 or the middle bearing 330. Here, if the first passage 414 is formed to be recessed in an upper surface of the lower bearing 420 or of the middle bearing 330, the first passage 414 may be formed at the same time that the second cylinder 410 or each bearing 420 and 430 is processed by sintering, thereby reducing a fabrication cost.

In the meantime, the second passage 415 may be arranged on the same line with the first passage 414, if possible, such that a pressure difference between a discharge pressure and a suction pressure can be generated at both side surfaces of the second vane 440, thereby allowing the second vane 440 to come in contact with the second vane slot 411. In some cases, the second passage 415 may also be formed on a parallel line to the first passage 414 or at least within an angle so as to be crossed with the first passage 414.

The second passage 415 may be positioned to be connected to the vane chamber 413 by a gap between the second vane 440 and the second vane slot 411 when the compressor is driven in the saving driving mode. However, if the second vane 440 is moved forward while the compressor is in the normal driving mode, when the second passage 415 is connected to the vane chamber 413, a discharge pressure Pd filled in the vane chamber 413 may be leaked to the second inlet 412 into which a refrigerant of a suction pressure Ps is introduced. Accordingly, the second vane 440 may not be satisfactorily supported. Hence, the second passage 415 may be formed to be positioned within a reciprocating range of the second vane 440.

The sectional area A of the second passage 415 may be in a range of 1.5% to 16.4% with respect to the vane area B of the vane 440 when dividing the sectional area A of the second passage 414 by the vane area B of the second vane 440, i.e., the vane area B of the side surface of the second vane 440 to which a restriction pressure is applied. Accordingly, noise generated during a driving mode switching can be minimized.

Although not shown in the drawings, the first passage 414 and the second passage 415 may be formed in plurality along a height direction of the second vane 440. Also, the sectional areas of the first passage 414 and the second passage 415 may be the same or different.

The mode switching unit 500 may include a low pressure side connection pipe 510 diverged from the second gas suction pipe SP2, a high pressure side connection pipe 520 connected to an inner space of the casing 100, a common side connection pipe 530 connected to the vane chamber 413 of the second cylinder 410 and alternately connected to both low pressure side connection pipe 510 and high pressure side connection pipe 520, a first mode switching valve 540 connected to the vane chamber 413 of the second cylinder 410 via the common side connection pipe 530, and a second mode switching valve 550 connected to the first mode switching valve 540 to control a switching of the first mode switching valve 540.

The low pressure side connection pipe 510 may be connected between a suction side of the second cylinder 410 and an inlet side gas suction pipe of an accumulator 110, or between the suction side of the second cylinder 410 and an outlet side gas suction pipe (second gas suction pipe SP2).

The high pressure side connection pipe 520 may be connected to a lower portion of the casing 100, i.e., to a portion lower than the second compression part 400. However, in this state, oil in the casing 100 is excessively introduced into the vane chamber 413. Accordingly, a pressure change of the vane chamber 413 may be delayed upon converting a driving mode of the compressor, resulting in increasing noise due to vibration generated by the vane. In addition, a viscosity index may be increased between the second vane slot 411 and the second vane 440, which may interrupt with a smooth operation of the vane. Therefore, preferably, the high pressure side connection pipe 520 may be installed at a higher portion where it is not sunk in oil, namely, the high pressure side connection pipe 520 may be connected between a lower end of the motor part 200 and an upper end of the first compression part 300 as shown in FIG. 1. A refrigerant of a discharge pressure filled in the inner space of the casing 100 may thusly flow towards the first mode switching valve 540. Also, here, a certain amount of oil should be supplied into the vane chamber 413 so as to lubricate between the second vane slot 411 and the second vane 440. Accordingly, a minute oil supplying hole (not shown) may be formed at the lower bearing 420 to thus supply oil when the second vane 440 performs a reciprocating motion.

An operational effect of the double type variable capacity rotary compressor according to the present invention will be described as follows.

That is, when the rotor 220 is rotated as power is applied to the stator 210 of the motor part 200, the rotational shaft 230 is rotated together with the rotor 220. A rotational force of the motor part 200 is accordingly transmitted to the first compression part 300 and the second compression part 400. Depending on a capacitance of an air conditioner, the first and second compression parts 300 and 400 are together normally driven (i.e., in a power driving mode), so as to generate a cooling capacity of a large capacitance. Alternatively, the first compression part 300 performs a normal driving and the second compression part 400 performs a saving driving, so as to generate a cooling capacity of a small capacitance.

Here, in case where the compressor or an air conditioner having the same is in a power driving mode, power is applied to the second mode switching valve 550. Accordingly, as shown in FIG. 4, the low pressure side connection pipe 510 is blocked while the high pressure side connection pipe 520 is connected to the common side connection pipe 530. Then, gas of high pressure or oil of high pressure within the casing 10 may supplied into the vane chamber 413 of the second cylinder 410 via the high pressure side connection pipe 520, and thereby the second vane 440 may be retreated by a pressure of the vane chamber 413. As a result, the second vane 440 may be maintained in a state of being in contact with the second rolling piston 430, and normally compress refrigerant gas introduced into the second compression space V2 and then discharge the compressed refrigerant gas.

At this time, a refrigerant gas or oil at a high pressure is supplied into the first passage 414 formed in the second cylinder 410 or the bearing 430 or 420 to thereby pressurize one side surface of the second vane 440. However, since the sectional area of the first passage 414 is smaller than that of the second vane slot 411, a pressurizing force of the vane chamber 413 in a lateral direction may be smaller than a pressurizing force of the vane chamber 413 in back and forth directions. As a result, the second vane 440 may not be restricted. Therefore, the first vane 350 and the second vane 440 are respectively in contact with the rolling pistons 340 and 440, to thereby divide the first compression space V1 and the second compression space V2 into a suction chamber and a compression chamber. As the first vane 310 and the second vane 440 compress each refrigerant sucked into each suction chamber and then discharge the compressed refrigerant, the compressor or the air conditioner having the same may perform a driving of 100%.

On the contrary, when the compressor or the air conditioner having the same is in a saving driving mode likewise the initial driving, the second mode switching valve 550 becomes a power-off state and accordingly is operated in an opposite way to the normal (power) driving, as shown in FIG. 5, to thereby connect the low pressure side connection pipe 510 to the common side connection pipe 530. As a result, a refrigerant gas of a low pressure sucked into the second cylinder 410 may be partially introduced into the vane chamber 413. Accordingly, the second vane 440 may be retreated by a pressure of the second compression space V2 to be received inside the second vane slot 411, and thus, the suction chamber and the compression chamber of the second compression space V2 may be connected to each other. The refrigerant sucked into the second compression space V2 may not be compressed.

Here, a great pressure difference is generated between a pressure applied onto one side surface of the second vane 440 by the first passage 414 formed in the second cylinder 410 or the bearing 430 or 420 and a pressure applied onto the other side surface of the second vane 440 by the second passage 415 formed in the second cylinder 410 or the bearing 430 or 420. Accordingly, the pressure applied via the first passage 414 may desirably be moved towards the second passage 415 and thusly the second vane 440 may efficiently rapidly be restricted without a vibration. In addition, at the time when a pressure of the vane chamber 413 is converted from a discharge pressure into a suction pressure, the discharge pressure remaining in the vane chamber 413 may be changed into a type of a middle pressure Pm. However, as the middle pressure Pm of the vane chamber 413 is leaked through the second passage 415 at a pressure lower than the middle pressure Pm, the pressure of the vane chamber 413 may be quickly converted into the suction pressure Ps. Accordingly, the second vane 440 may be more efficiently prevented from being vibrated, which results in a fast and effective restriction of the second vane 440. Hence, as the suction chamber and the compression chamber of the second cylinder 410 are connected to each other, a refrigerant sucked into the suction chamber of the second cylinder 410 may not be compressed but rather is sucked back into the suction chamber along the locus of the rolling piston 430. As a result, the second compression part 400 may not compress the refrigerant, and thus the compressor or the air conditioner having the same performs a driving with a capacity corresponding to only the capacity of the first compression part 300.

Here, when a ratio between the sectional area A of the first passage 414 or the second passage 415 and a one side vane area B of the vane is in range of 1.5%~16.4%, a restriction force may be increased with respect to the second vane 440, which allows the second vane 440 to be quickly restricted. The appropriate ratio may be equally applied to a ratio between the sum of sectional areas of the first passage 414 and the second passage 415 and an area obtained by adding the vane areas of both side surfaces of the vane 440.

Test results are shown in FIGS. 6 and 7. That is, it can be noticed from FIG. 6 that the mode switching noise is generated for about 0.24 seconds when the sectional area A of the passage corresponds to 1.5% of the vane area B of the vane, and thusly the noise is decreased by approximately 1/10 as compared to that in the related art. Also, it can be noticed from FIG. 7 that the mode switching noise is not generated when the sectional area A of the passage corresponds to 16.4% of the vane area B of the vane.

Mode For The Invention

Meanwhile, the foregoing embodiments have shown the case of having the high pressure side vane restricting passage and the low pressure side vane restricting passage, but they may be applied to a case of only having the high pressure side vane restricting passage as shown in FIG. 8.

That is, in case where the high pressure side vane restricting passage (hereinafter, 'first passage') is formed at the second vane slot 411 of the second cylinder 410, if the sectional area A of the first passage 414 is formed to be in range of 1.5%~16.4% with respect to the vane area B of the second vane 440, as shown in the foregoing embodiments, the second vane 440 may be fast and stably restricted by a pressure applied from the first passage 414. Accordingly, noise generated when the driving mode of the compressor is converted from a normal driving mode into a saving driving mode may be drastically reduced. A detailed description and operation effects therefor are the same as or similar to the aforementioned embodiments and will thusly be omitted.

Industrial Applicability

The variable capacity rotary compressor according to the present invention can be applied to a single type rotary compressor as well as a double type rotary compressor, and also be applied to every compression part in the double type rotary compressor.

The invention claimed is:

1. A variable capacity rotary compressor comprising:

a casing;

a cylinder assembly installed inside the casing and having a compression space;

a rolling piston eccentrically rotated in the compression space of the cylinder assembly;

a vane coming in contact with the rolling piston to perform a linear reciprocation in a radial direction and thus divide the compression space of the cylinder assembly into a suction chamber and a discharge chamber; and a vane restricting device for restricting the vane by applying a pressure onto a side face of the vane, wherein a sectional area A of a passage through which the restriction pressure is applied to the side face of the vane is formed so as not to be larger than a vane area B of the vane to which the restriction pressure is applied through the passage, wherein the passage comprises:

a first passage for connecting an inner space of the casing to a vane slot which is provided in the cylinder assembly and has the vane slidably inserted therein; and a second passage for connecting the vane slot to an inlet which is connected to the suction chamber of the cylinder assembly.

2. The rotary compressor of claim 1, wherein a ratio (A/B) of the sectional area A of the passage to the vane area B ranges from 1.5% to 16.4%.

3. The rotary compressor of claim 1, wherein the passage is formed to be approximately perpendicular to a vane slot.

4. The rotary compressor of claim 1, wherein a sectional area of the first passage is formed to be approximately the same as a sectional area of the second passage.

5. The rotary compressor of claim 1, wherein a vane chamber separated from the inner space of the casing is formed at an outer side of the vane slot.

6. The rotary compressor of claim 5, wherein a gap is formed between the vane and the vane slot such that the vane chamber is connected to the passage when the vane is retreated into the vane slot.

7. The rotary compressor of claim 1, wherein a mode switching unit is connected to the vane chamber to allow a suction pressure or a discharge pressure to be supplied into the vane chamber according to a driving mode of the compressor.

8. The rotary compressor of claim 7, wherein the mode switching unit comprises:

a common side connection pipe connected to the vane chamber;

a low pressure side connection pipe connected to an inlet of the cylinder assembly;

a high pressure side connection pipe connected to the inner space of the casing; and a mode switching valve respectively connected to the common side connection pipe, the low pressure side connection pipe and the high pressure side connection pipe, so as to either connect the low pressure side connection pipe to the common side connection pipe or connect the high pressure side connection pipe to the common side connection pipe according to a driving mode of the compressor, wherein the high pressure side connection pipe is coupled to the casing such that an end of the high pressure side connection pipe is positioned to be higher than a surface of oil filled in the inner space of the casing.

9. The rotary compressor of claim 8, wherein the high pressure side connection pipe has an end coupled to a position which is not lower than the cylinder assembly.

10. The rotary compressor of claim 9, wherein a motor part which generates a driving force to compress a refrigerant is disposed at an upper side of the cylinder assembly, and the high pressure side connection pipe is connected between the motor part and the cylinder assembly.

* * * * *